United States Patent [19]

Lok et al.

[11] Patent Number: 4,607,001

[45] Date of Patent: Aug. 19, 1986

[54] DIVALENT CHALCOGENIDE FOG INHIBITING AGENTS FOR SILVER HALIDE PHOTOGRAPHY

[75] Inventors: Roger Lok, Hilton; Wolfgang H. H. Gunther, Webster, both of N.Y.

[73] Assignee: Eastman Kodak Company, Rochester, N.Y.

[21] Appl. No.: 719,839

[22] Filed: Apr. 4, 1985

[51] Int. Cl.[4] ..... G03C 1/34

[52] U.S. Cl. ..... 430/428; 430/607; 430/612; 430/449; 430/489; 430/448; 430/599; 430/570

[58] Field of Search ..... 430/603, 607, 612, 449, 430/489, 428, 448, 599, 570

[56] References Cited

U.S. PATENT DOCUMENTS 3,397,986 8/1968 Millikan et al. .
3,447,925 6/1969 Dersch et al. ..... 430/428
3,811,896 5/1974 Herz et al. .
4,144,062 3/1979 Lelenthal et al. .
4,152,155 5/1979 Lelenthal et al. .

FOREIGN PATENT DOCUMENTS 2135176 4/1972 France .
53-57817 5/1978 Japan .
1282303 3/1970 United Kingdom .

OTHER PUBLICATIONS

*Research Disclosure,* vol. 176, Dec. 1978, Item 17643.

*Primary Examiner*—Won H. Louie
*Attorney, Agent, or Firm*—Carl O. Thomas

[57] ABSTRACT

Radiation sensitive silver halide photographic elements are disclosed which are protected from fog by aromatic tellurochalcogenides. The aromatic tellurochalcogenides can be initially incorporated in the photographic element as manufactured or during processing.

15 Claims, No Drawings

DIVALENT CHALCOGENIDE FOG INHIBITING AGENTS FOR SILVER HALIDE PHOTOGRAPHY

FIELD OF THE INVENTION

This invention relates to photography. It relates to silver halide photographic elements and to imaging processes.

BACKGROUND OF THE INVENTION

In the course of processing a photographic element containing an imagewise exposed silver halide emulsion layer reduced silver can be formed either as a direct or inverse function of exposure. At the same time, at least a low level of reduced silver formation also occurs independently of imagewise exposure. The term "fog" is herein employed to indicate the density of the processed photographic element attributable to the latter, usually measured in minimum density areas. In color photography fog is typically observed as image dye density rather than directly as silver density.

Over the years a variety of differing materials have been introduced into silver halide emulsions to inhibit the formation of fog. *Research Disclosure,* Vol. 176, December 1978, Item 17643, Section VI, lists the more commonly employed fog inhibiting agents. *Research Disclosure* is published by Kenneth Mason Publications, Ltd., The Old Harbourmaster's, 8 North St., Emsworth, Hampshire P010 7DD, England.

It is known to employ as fog inhibiting agents compounds having two aromatic nuclei linked by two divalent sulfur atoms and analogous compounds in which one or both of the sulfur atoms are replaced by selenium atoms. Exemplary of such fog inhibiting agents are those disclosed by Millikan et al U.S. Pat. No. 3,397,986, Pollet et al U.K. Specification No. 1,282,303, and Herz et al U.S. Pat. No. 3,811,896 and French Pat. No. 2,135,176. While the two Herz et al patents are counterparts, the French patent contains pertinent subject matter which is not common to both.

Lelenthal et al U.S. Pat. Nos. 4,144,062 and 4,152,155 disclose photothermographic imaging systems employing an oxidizing agent and a reducing agent in combination with a catalyst, which in one form can be silver halide. The oxidizing agent is an organotellurium (II) or (IV) compound which in one form can be comprised of two aromatic nuclei linked by two divalent tellurium atoms. Compared to the catalyst, the oxidizing agent is present in relatively high concentrations.

Asahi Japanese Kokai No. 57817/78, laid open May 25, 1978, discloses the use of a variety of tellurium compounds as chemical sensitizers for silver halide emulsions. In one of a variety of differing forms the tellurium compounds can satisfy the formula $$R_1—Te—Te—R_2$$

wherein $R_1$ and $R_2$ are organic groups, such as substituted or unsubstituted alkyl or aryl groups or carbonyl containing organic groups. Aryl substituents disclosed are methyl, ethyl, methoxy, amino, dimethylamino, hydroxyl, and halogen.

SUMMARY OF THE INVENTION

In one aspect this invention is directed to a photographic element containing a radiation sensitive silver halide emulsion and a nonsensitizing amount of a fog inhibiting agent comprised of at least two divalent middle chalcogen atoms linking two aromatic nuclei characterized in that at least one of said middle chalcogen atoms is a tellurium atom.

In another aspect this invention is directed to a method of producing a photographic image comprising processing a photographic element containing at least one imagewise exposed silver halide emulsion in an aqueous solution containing a nonsensitizing amount of a fog inhibiting agent comprised of at least two divalent middle chalcogen atoms linking two aromatic nuclei characterized in that at least one of said middle chalcogen atoms is a tellurium atom.

The present invention permits the use of photographic elements containing radiation sensitive silver halide emulsions to produce photographic images exhibiting low levels of fog. At the same time sensitization attributable to the presence of a fog inhibiting agent is avoided. The invention affords an alternative and generally superior approach to fog inhibition that allows fog inhibiting agent concentrations to be reduced as compared to aromatic diselenide and aromatic disulfide fog inhibiting agents by approximately an order of magnitude.

DESCRIPTION OF PREFERRED EMBODIMENTS

The present invention is based on the discovery that compounds having two aromatic nuclei linked by two or more divalent middle chalcogen atoms are particularly effective fog inhibiting agents for silver halide emulsions when at least one of the divalent middle chalcogen atoms is a tellurium atom. Such compounds are hereinafter more succinctly referred to as aromatic tellurochalcogenides. In a preferred form, in which the aromatic nuclei are linked by two divalent tellurium atoms, the compounds are hereinafter referred to as aromatic ditellurides. The middle chalcogen atoms are sulfur, selenium, and tellurium.

The fog inhibiting agents employed in the practice of this invention can be analogues of known aromatic disulfide and aromatic diselenide fog inhibiting agents as well as corresponding fog inhibiting agents employing a combination of divalent sulfur and selenium atoms linking two aromatic nuclei. That is, the fog inhibiting agents can be similar to those of Millikan et al U.S. Pat. No. 3,397,986, Pollet et al U.K. Specification No. 1,282,303, and Herz et al U.S. Pat. No. 3,811,896 and French Pat. No. 2,135,176, cited above, except that one or both of the linking sulfur or selenium atoms is replaced by a divalent tellurium atom.

Aromatic ditellurides useful as fog inhibiting agents in the practice of this invention can be chosen from a variety of known aromatic ditellurides. The following is a listing of aromatic ditellurides together with their Chemical Abstracts registry numbers provided parenthetically:

| | |
|---|---|
| Te-1 | Di-2-naphthalenyl ditelluride (1666-12-2) |
| Te-2 | 2,2'-Ditellurobisbenzoic acid (28192-23-6) |
| Te-3 | 2,2'-ditellurodibenzoyl chloride (28192-24-7) |
| Te-4 | Bis(4-bromophenyl) ditelluride (28192-35-0) |
| Te-5 | 2,2'-ditellurobis[3-bromoanisole] (28192-36-1) |
| Te-6 | 2,2'-ditellurobisbenzaldehyde (28192-55-4) |
| Te-7 | Bis(4-methylphenyl) ditelluride (32294-57-8) |
| Te-8 | Di-1-naphthalenyl ditelluride (32294-58-9) |
| Te-9 | Diphenyl ditelluride (32294-60-3) |
| Te-10 | Bis(4-methoxyphenyl) ditelluride (35684-37-8) |
| Te-11 | Bis(4-ethoxyphenyl) ditelluride (35684-38-9) |

-continued

| | |
|---|---|
| Te-12 | Bis(4-phenoxyphenyl) ditelluride (35684-39-0) |
| Te-13 | Bis(4-butoxyphenyl) ditelluride (36062-83-6) |
| Te-14 | Bis(4-propoxyphenyl) ditelluride (36062-84-7) |
| Te-15 | 4,4'-ditellurobisphenol diacetate (36062-85-8) |
| Te-16 | Bis(4-chlorophenyl) ditelluride (36062-86-9) |
| Te-17 | Bis(3-fluorophenyl) ditelluride (36062-88-1) |
| Te-18 | Bis(3,4-dimethoxyphenyl) ditelluride (36062-89-2) |
| Te-19 | 1,1'-(Ditellurodi-2,1-phenylenebisethanone) (36066-64-5) |
| Te-20 | 2,2'-(Ditellurodi-2,1-phenylene)bis[2-methyl-1,3-dioxolane] (36066-65-6) |
| Te-21 | 4,4'-Ditellurobisphenol dipropanoate (36274-40-5) |
| Te-22 | Bis(2-methylphenyl) ditelluride (36692-34-9) |
| Te-23 | Bis(2-chlorophenyl) ditelluride (36692-35-0) |
| Te-24 | Bis([1,1'-biphenyl]-4-yl) ditelluride (36692-38-3) |
| Te-25 | Bis(4-fluorophenyl) ditelluride (36829-95-5) |
| Te-26 | Bis(4-methoxy-3-methylphenyl) ditelluride (37438-24-7) |
| Te-27 | Bis([1,1'-biphenyl]-2-yl) ditelluride (55776-27-7) |
| Te-28 | Bis(3-methylphenyl) ditelluride (56821-75-1) |
| Te-29 | Bis(2-methoxyphenyl) ditelluride (56821-76-2) |
| Te-30 | Bis(3-chlorophenyl) ditelluride (65082-24-8) |
| Te-31 | Bis(3-bromophenyl) ditelluride (65082-25-9) |
| Te-32 | [Ditellurobis(5-methyl-2,1-phenylene)]-bis{-[2-(methylthio)phenyl]methanone} (67184-40-1) |
| Te-33 | 2,2'-Ditellurobisbenzoic acid, diethyl ester (67915-87-1) |
| Te-34 | (Ditellurodi-2,1-phenylene)bis[phenylmethanone] (67915-94-0) |
| Te-35 | (Ditellurodi-4,1-phenylene)bis[phenylmethanone] (67915-93-9) |
| Te-36 | Bis[2-(phenylmethyl)phenyl] ditelluride (69219-18-7) |
| Te-37 | Bis(4-pentylphenyl) ditelluride (70057-90-8) |
| Te-38 | 2,2'-Ditellurobisbenzenamine (72695-32-0) |
| Te-39 | 2,2'-[Ditellurobis(4,1-phenyleneoxy)]bisacetic acid, dimethyl ester (79402-09-8) |
| Te-40 | 4-Chlorophenyl 4-ethoxyphenyl ditelluride (80152-97-2) |
| Te-41 | 4-Ethoxyphenyl 4-methylphenyl ditelluride (80152-98-3) |
| Te-42 | Bis(3,5-dimethoxyphenyl) ditelluride (84144-31-0) |
| Te-43 | Di-9-anthracenyl ditelluride (84174-14-1) |
| Te-44 | 2,2'-(Ditellurodi-4,1-phenylene)bis[2-methyll,3-dioxolane] (84280=95-5) |
| Te-45 | 3,3'-(Ditelluro-di-2,1-phenylene)bis-2-propenal (89079-76-5) |

Although the Chemical Abstracts registry contains approximately 6 million compounds, it is limited to the chemical literature published since 1965. Ludwig Reichel and Ernst Kirschbaum, Uber Aromatische Tellurverbindungen (I. Mitteilung uber Organometallverbindungen), *Analen der Chemie,* Vol. 523, 1936, pp. 211–221, describes the preparation of additional ditellurides, including

| | |
|---|---|
| Te-46 | Bis(4-acetamidophenyl) ditelluride. |

Amido, including ortho amido, substituted aromatic tellurochalcogenides are the specific subject matter of Gunther et al U.S. Ser. No. 719,838, filed concurrently herewith and commonly assigned, titled AMIDO SUBSTITUTED DIVALENT CHALCOGENIDE FOG INHIBITING AGENTS FOR SILVER HALIDE PHOTOGRAPHY, here incorporated by reference.

Gunther et al U.S. Ser. No. 660,155, filed Oct. 12, 1984, PHOTOGRAPHICALLY USEFUL CHALCOGENAZOLES, CHALCOGENAZOLINES, AND CHALCOGENAZOLINIUM AND CHALCOGENAZOLIUM SALTS also discloses the preparation of aromatic ditellurides.

Although aromatic ditellurides constitute conveniently available compounds for the practice of this invention, the fog inhibiting agents can take other forms in which one or more other middle chalcogen atoms replace one of the tellurium atoms. Typical of known compounds of this type are the following exemplary compounds, Chemical Abstracts registry numbers again being provided in parenthesis:

| | |
|---|---|
| Te-47 | 4-Chlorobenzeneselenotelluroic acid, 4-chlorophenyl ester (87291-85-8) |
| Te-48 | Benzenesulfenotelluroic acid, phenyl ester (87291-84-7) |
| Te-49 | 4-Methoxybenzeneselenotelluroic acid, 4-methoxyphenyl ester |
| Te-50 | Benzeneselenotelluroic acid, 4-methylphenyl ester (56950-11-9) |
| Te-51 | Benzeneselenotelluroic acid, phenyl ester (56958-10-9) |
| Te-52 | 2,2'-[Selenobis(telluro)]bisbenzoic acid, diethyl ester (79313-68-1) |
| Te-53 | Bis(4-methoxybenzenetellurenyl) selenide (80712-64-7) |
| Te-54 | Benzenesulfenotelluroic acid, 2-acetylphenyl ester (59550-58-2) |
| Te-55 | Benzenetellurenoselenoic acid, anhydroselenide (52443-86-4) |

The fog inhibiting agents employed in the practice of this invention include those represented by the formula:

$$\text{Ar—Te—Ch—Ar}' \qquad \text{(I)}$$

wherein

Ar and Ar' are aromatic nuclei and

Ch is one or more middle chalogen atoms.

Since it is believed that in use cleavage of the chalcogen to chalcogen bond occurs to produce Ar-Te and Ar'-Ch moieties that inhibit fog formation, the presence of more than two middle chalcogen atoms in the linking group is not necessary. Thus, the preferred compounds are those in which Ch is a single middle chalcogen atom.

Specifically preferred compounds for the practice of this invention are aromatic ditellurides satisfying the formula:

$$\text{Ar—Te—Te—Ar}' \qquad \text{(II)}$$

wherein

Ar and Ar' are aromatic nuclei.

As is apparent from the specific aromatic tellurochalcogenides identified above, the aromatic nuclei can take a variety of forms and can be either substituted or unsubstituted. Carbocyclic aromatic nuclei, such as phenyl, biphenyl, and naphthyl nuclei, are more commonly encountered. However, heterocyclic nuclei which exhibit aromaticity, such as pyridyl, quinolyl, benzimidazolyl, benzothiazolyl, and similar aromatic heterocylic nuclei, can replace either or both carbocyclic aromatic nuclei.

The aromatic nuclei can each be unsubstituted or either or both can be independently substituted. Alkyl, aryl, aralkyl, and alkaryl substituents linked directly to the aromatic nucleus or through an oxygen atom, a sulfur atom, a carbonyl group, or an oxycarbonyl group. Alkoxy substituents constitute a specifically preferred class of substituents. Formyl substituents and halo substituents such as chloro, bromo, and fluoro substitutents are particularly contemplated. Amino and amido substituent groups represent preferred substituents. Heterocyclic substituents are contemplated.

From the prior listing of aromatic ditellurides it is apparent that the aromatic nuclei can be singly or multiply substituted, with up to four ring substituents being common. Further, the substituents can themselves be substituted. For example, haloalkyl and haloaryl substituents as well as ester and oxyester moieties appear in the prior listing of aromatic ditellurides. Thus, it is apparent that the aromatic nucleus substituents, when present, can take a wide variety of forms. A phenyl group is a preferred aromatic nucleus and a preferred aromatic substituent of the aromatic nucleus. It is generally preferred that aliphatic substituents of the aromatic nucleus individually have 6 or fewer carbon atoms.

From investigations illustrated by the examples below it has been observed that the aromatic tellurochalcogenides exhibit marked superiority as fog inhibiting agents over corresponding known fog inhibiting agents having only middle chalcogen atoms other than tellurium. The aromatic nuclei, including their substituents, have identifiable modifying effects. However, the effects appear to be secondary to the differences produced by the presence or absence of one or more tellurium linking atoms. Thus, it is considered that the advantages can be realized with a wide variety of aromatic nuclei, including aromatic nuclei substituents, and that in general the aromatic nuclei, including their substituents, that are useful correspond to those reported for aromatic disulfide and aromatic diselenide fog reducing agents, although the degree of effectiveness may vary.

The aromatic tellurochalcogenide fog inhibiting agents are preferably incorporated in the photographic element to be protected prior to exposure and processing—e.g., at the time of manufacture. When the aromatic tellurochalcogenide is being relied upon to reduce fog the origin of which antedates processing, it is essential that the aromatic tellurochalcogenide be incorporated in the silver halide emulsion layer or layers to be protected. It is generally most convenient to introduce the aromatic tellurochalcogenide into the silver halide emulsion after chemical ripening of the emulsion and before coating.

When the aromatic tellurochalcogenide is intended to become active at the time of processing, it can be incorporated within the photographic element at any location which permits permeation of one or more silver halide emulsion layers being imagewise developed. For example, the aromatic tellurochalcogenide can be located in one or more silver halide emulsion layers or other hydrophilic colloid layers, such as in an overcoat, interlayer, or subbing layer. When the aromatic tellurochalcogenide is intended to become active at the time of processing, it is generally most convenient to add the aromatic tellurochalcogenide as a component of a processing solution, such as predevelopment bath or a developer, allowing it to permeate the silver halide emulsion layer or layers prior to or during development.

Any nonsensitizing amount of aromatic tellurochalcogenide effective to reduce fog can be employed. As is generally understood by those skilled in the art, when the effect of a fog inhibiting agent on a silver halide emulsion is examined as a function of its concentration, fog inhibition is observed to increase with increasing concentrations of the fog inhibiting agent. However, beyond a threshold concentration level photographic speed also decreases as a direct function of fog inhibiting agent concentration. Thus, maximum fog inhibiting agent concentrations are chosen to balance fog inhibition against speed loss. To avoid excessive speed loss fog inhibiting agent concentrations herein contemplated are in every instance less than 5 and usually less than 1 millimole per mole of silver in the radiation sensitive silver halide emulsion layer.

If very low levels of fog inhibiting agent are employed, less than full fog inhibition is realized, and, depending upon the choice of fog inhibiting agent, an actual increase in photographic speed can be observed attributable to the presence of the fog inhibiting agent. Thus, achieving optimum fog inhibition and photographic sensitization with a fog inhibition agent are incompatible. The useful concentrations of fog inhibiting agents herein contemplated are in every instance greater than minimal threshold fog inhibiting concentrations that give rise to sensitization—i.e., an observable photographic speed increase. Stated another way, only nonsensitizing concentrations of the fog inhibiting agents employed in the practice of this invention are contemplated.

Optimum amounts of fog inhibiting agents for specific applications are usually determined empirically by varying concentrations. Such investigations are typically relied upon to identify optimum fog reduction concentrations or an optimum balance between fog reduction and other effects, such as reduction in photographic speed. Based on the investigations reported below, when the aromatic tellurochalcogenide is incorporated in a silver halide emulsion prior to coating, concentrations of at least about 0.05 millimole per silver mole in the radiation sensitive silver halide emulsion layer of incorporation is contemplated. A preferred minimum concentration of the fog inhibiting agent when incorporated in a radiation sensitive silver halide emulsion is 0.1 millimole per silver mole. It is to be noted that the aromatic tellurochalcogenides exhibit fog inhibiting activities that correspond to those of conventional aromatic disulfide and diselenide fog inhibiting agents employed at approximately an order of magnitude higher concentration levels. When the aromatic tellurochalcogenide is incorporated in a processing solution, concentration ranges from minimum effective amounts—e.g., typically at least 0.05 millimole per liter—to up to about 0.5 millimole per liter are contemplated.

It is, of course, recognized that conventional fog inhibiting agents, such as those illustrated by *Research Disclosure,* Item 17643, Section VI, cited above, can be employed in combination with aromatic tellurochalcogenide in the practice of this invention. Since it is recognized that fog inhibiting agents operate by a variety of differing mechanisms, the effects produced by combinations of aromatic tellurochalcogenide and conventional fog inhibiting agents will range from highly interdependent to independently additive, but in any case optimum concentrations are susceptible to empirical determination.

In addition to the fog inhibiting agent this invention additionally requires a photographic element containing a radiation sensitive silver halide emulsion. These silver halide emulsions can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains of either regular (e.g., cubic or octahedral) or irregular (e.g., multiply twinned or tabular) crystallographic form. Recently developed high aspect ratio tabular grain emulsions, such as those disclosed by Wilgus et al U.S. Pat. Nos. 4,434,226, Daubendiek et al 4,414,310, Wey 4,399,215, Solberg et al 4,433,048, Mignot 4,386,156, Evans et al 4,504,570, Maskasky 4,400,463, Wey et al 4,414,306, and Maskasky 4,435,501, are specifically contemplated. Sensitizing compounds, such as compounds of copper, thallium, lead, bismuth, cadmium and Group VIII noble metals, can be present during precipitation of the silver halide emulsion, as illustrated by Arnold et al U.S. Pat. Nos. 1,195,432, Hochstetter 1,951,933, Trivelli et al 2,448,060, Overman 2,628,167, Mueller et al 2,950,972, Sidebotham 3,488,709 and Rosecrants et al 3,737,313.

The silver halide emulsions can be either monodisperse or polydisperse as precipitated. The grain size distribution of the emulsions can be controlled by silver halide grain separation techniques or by blending silver halide emulsions of differing grain sizes. The emulsions can include Lippmann emulsions and ammoniacal emulsions, as illustrated by Glafkides, *Photographic Chemistry,* Vol. 1, Fountain Press, London, 1958, pp. 365–368 and pp. 301–304; excess halide ion ripened emulsions as described by G. F. Duffin, *Photographic Emulsion Chemistry,* Focal Press Ltd., London, 1966, pp. 60–72; thiocyanate ripened emulsions, as illustrated by Illingsworth U.S. Pat. No. 3,320,069; thioether ripened emulsions, as illustrated by McBride U.S. Pat. Nos. 3,271,157, Jones 3,574,628 and Rosecrants et al 3,737,313 or emulsions containing weak silver halide solvents, such as ammonium salts, as illustrated by Perignon U.S. Pat. No. 3,784,381 and *Research Disclosure,* Vol. 134, June 1975, Item 13452.

The emulsions can be surface-sensitive emulsions—i.e., emulsions that form latent images primarily on the surfaces of the silver halide grains—or internal latent image-forming emulsions— i.e., emulsions that form latent images predominantly in the interior of the silver halide grains, as illustrated by Knott et al U.S. Pat. Nos. 2,456,953, Davey et al 2,592,250, Porter et al 3,206,313 and 3,317,322, Bacon et al 3,447,927, Evans 3,761,276, Morgan 3,917,485, Gilman et al 3,979,213, Miller 3,767,413, and Evans et al 4,504,570.

The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent, as illustrated by Ives U.S. Pat. Nos. 2,563,785, Evans 3,761,276, Knott et al 2,456,953, Jouy 3,511,662, and Evans et al 4,504,570.

Blends of surface sensitive emulsions and internally fogged, internal latent image-forming emulsions can be employed, as illustrated by Luckey et al U.S. Pat. Nos. 2,996,382, 3,397,987 and 3,705,858, Luckey 3,695,881, *Research Disclosure,* Vol. 134, June 1975, Item 13452, Millikan et al Defensive Publication No. T-904017, Apr. 21, 1972 and Kurz *Research Disclosure,* Vol. 122, June 1974, Item 12233.

The aromatic tellurochalcogenide compounds are preferably employed to reduce fog in negative working silver halide emulsions and most preferably those that contain silver halide grains which form surface latent images on exposure.

The silver halide emulsions can be surface sensitized. Noble metal (e.g., gold), middle chalcogen (e.g., sulfur, selenium, or tellurium), and reduction sensitizers, employed individually or in combination are specifically contemplated. Typical chemical sensitizers are listed in *Research Disclosure,* Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure,* Item 17643, cited above, Section IV.

The silver halide emulsions as well as other layers of the photographic elements of this invention can contain as vehicles hydrophilic colloids, employed alone or in combination with other polymeric materials (e.g., latices). Suitable hydrophilic materials include both naturally occurring substances such as proteins, protein derivatives, cellulose derivatives—e.g., cellulose esters, gelatin—e.g., alkali treated gelatin (cattle, bone, or hide gelatin) or acid treated gelation (pigskin gelatin), gelatin derivatives—e.g., acetylated gelatin, phthalated gelatin, and the like, polysaccharides such as dextran, gum arabic, zein, casein, pectin, collagen derivatives, collodion, agar-agar, arrowroot, and albumin. The vehicles can be hardened by conventional procedures. Further details of the vehicles and hardeners are provided in *Research Disclosure,* Item 17643, cited above, Sections IX and X.

The silver halide photographic elements of this invention can contain other addenda conventional in the photographic art. Useful addenda are described, for example, in *Research Disclosure,* Item 17643, cited above. Other conventional useful addenda include desensitizers, couplers (such as dye forming couplers, masking couplers and DIR couplers) DIR compounds, anti-stain agents, image dye stabilizers, absorbing materials such as filter dyes and UV absorbers, light scattering materials, antistatic agents, coating aids, plasticizers and lubricants, and the like.

The photographic elements of the present invention can be simple black-and-white or monochrome elements comprising a support bearing a layer of the silver halide emulsion, or they can be multilayer and/or multicolor elements. The photographic elements produce images ranging from low contrast to very high contrast, such as those employed for producing half tone images in graphic arts. They can be designed for processing with separate solutions or for in-camera processing. In the latter instance the photographic elements can include conventional image transfer features, such as those illustrated by *Research Disclosure,* Item 17643, cited above, Section XXIII. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image forming units, can be arranged in various orders as known in the art. In an alternative format, the emulsion or emulsions can be disposed as one or more segmented layers, e.g., as by the use of microvessels or microcells, as described in Whitmore U.S. Pat. No. 4,387,154.

A preferred color photographic element according to this invention comprises a support bearing at least one blue sensitive silver halide emulsion layer having associated therewith a yellow dye forming coupler, at least one green sensitive silver halide emulsion layer having associated therewith a magenta dye forming coupler and at least one red sensitive silver halide emulsion layer having associated therewith a cyan dye forming coupler, at least one of the silver halide emulsion layers containing an aromatic tellurochalcogenide fog inhibiting compound.

The elements of the present invention can contain additional layers conventional in photographic elements, such as overcoat layers, spacer layers, filter layers, antihalation layers, scavenger layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* Item 17643, cited above, Section XVII.

The photographic elements can be imagewise exposed with various forms of energy, which encompass the ultraviolet, visible, and infrared regions of the electromagnetic spectrum as well as electron beam and beta radiation, gamma ray, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements, such as those illustrated by *Research Disclosure,* Vol. 184, August 1979, Item 18431.

Processing of the imagewise exposed photographic elements in the presence of the aromatic tellurochalcogenide need not differ from conventional processing. Processing procedures, developing agents, and development modifiers are illustrated by *Research Disclosure,* Item 17643, cited above, Sections XIX, XX, and XXI, respectively. In its preferred application the invention relates to silver halide photographic elements which are processed in aqueous alkaline developers in the presence of the aromatic tellurochalcogenide.

The following examples further illustrate the invention. The C is employed to identify control compounds.

EXAMPLES 1 THROUGH 3

The superior fog inhibiting activity of aromatic ditellurides Te-9, Te-18, and Te-38 over aromatic disulfides and aromatic diselenides is shown in Table I. These compounds were evaluated in a polydisperse sulfur plus gold sensitized silver bromoiodide emulsion. The compounds were added at the levels indicated and coated on cellulose acetate support to achieve a silver coverage of 4.89 g/m$^2$ and a gelatin coverage of 11.09 g/m$^2$. Samples of the coatings were exposed to a tungsten light source in an Eastman 1B Sensitometer through a wedge spectrograph. The coatings were developed for five minutes in a hydroquinone-Elon ® (p-aminophenol hemisulfate) developer, fixed, washed and dried. Samples of each of the coatings were incubated for two weeks at 49° C. under 50 percent relative humidity before being exposed and processed as described above. A characteristic (density vs log exposure) curve was plotted for each coating. The sensitivity and fog data was determined from these curves. The results are recorded in Table I.

The data in Table I demonstrate superior fog inhibiting activity of the aromatic ditellurides over the aromatic diselenide and aromatic disulfide. It is further noted that the fog inhibiting effects produced by the aromatic ditellurides are superior to the fog inhibiting effects produced by the aromatic diselenide and aromatic disulfide even when the aromatic ditellurides are present at an order of magnitude lower concentration levels.

TABLE I

| | Fog Inhibiting Activity | | | | | |
|---|---|---|---|---|---|---|
| | | | Fresh | | Incubation | |
| Structure | Compound | Level mmoles/ mole Ag | Relative Sensitivity | Fog | Relative Sensitivity | Fog |
| Control | — | — | 100 | 0.08 | 80 | 0.80 |
| 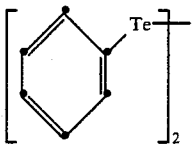 | Te-9 | 0.05 | 102 | 0.07 | 76 | 0.15 |
| | | 0.15 | 97 | 0.08 | 45 | 0.18 |
| 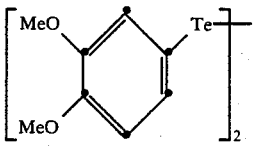 | Te-18 | 0.05 | 59 | 0.08 | 87 | 0.26 |
| | | 0.15 | 19.5 | 0.05 | 23.5 | 0.12 |
| 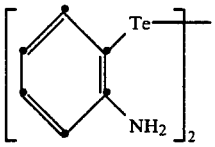 | Te-38 | 0.05 | 76 | 0.06 | 69 | 0.20 |
| | | 0.15 | 65 | 0.06 | 21 | 0.30 |

TABLE I-continued

| Structure | Compound | Fog Inhibiting Activity: Level mmoles/mole Ag | Fresh: Relative Sensitivity | Fresh: Fog | Incubation: Relative Sensitivity | Incubation: Fog |
|---|---|---|---|---|---|---|
| 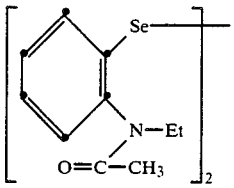 | C-1 | 0.15 | 74 | 0.29 | 118 | 0.35 |
| | | 1.50 | 45 | 0.32 | 71 | 0.32 |
| 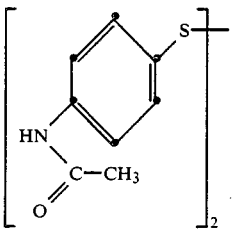 | C-2 | 0.15 | 69 | 0.06 | 126 | 0.32 |
| | | 1.50 | 39 | 0.05 | 87 | 0.21 |

This invention has been decribed in detail with reference to preferred embodiments thereof, but it will be understood that variations and modifications can be effected within the spirit and scope of the invention.

What is claimed is:

1. A photographic element containing a radiation sensitive silver halide emulsion and a nonsensitizing amount of a fog inhibiting agent comprised of at least two divalent middle chalcogen atoms linking two carbocyclic aromatic nuclei characterized in that at least one of said middle chalcogen atoms is a tellurium atom.

2. A photographic element according to claim 1 further characterized in that said silver halide emulsion contains surface latent image forming silver halide grains.

3. A photographic element according to claim 2 further characterized in that said silver halide grains are surface chemically sensitized.

4. A photographic element according to claim 2 further characterized in that said silver halide grains are spectrally sensitized.

5. A photographic element according to claim 1 further characterized in that said two middle chalcogen atoms link said aromatic nuclei.

6. A photographic element according to claim 1 further characterized in that said fog inhibiting agent is incorporated in said silver halide emulsion.

7. A photographic element according to claim 6 further characterized in that said fog inhibiting agent is present in a concentration of less than 1.0 millimole per silver mole.

8. A photographic element according to claim 7 further characterized in that said fog inhibiting agent is present in a concentration of at least 0.05 millimole per silver mole.

9. A photographic element according to claim 1 further characterized in that said fog inhibiting agent satisfies the formula $$Ar—Te—Ch—Ar'$$

wherein

Ar and Ar' are carbocyclic aromatic nuclei and

Ch is a middle chalcogen atom chosen from the class consisting of sulfur, selenium, and tellurium.

10. A photographic element according to claim 9 further characterized in that said fog inhibiting agent is an aromatic ditelluride.

11. A photographic element according to claim 10 further characterized in said aromatic nuclei are phenyl nuclei.

12. A photogaphic element according to claim 11 further characterized in that said phenyl nuclei are alkoxy substituted.

13. A photographic element according to claim 11 in which said aromatic ditelluride is chosen from the group consisting of diphenyl ditelluride, bis(3,4-dimethoxyphenyl) ditelluride, and 2,2'-ditellurobisbenzeneamine.

14. A process of producing a photographic image comprising processing a photographic element containing at least one imagewise exposed silver halide emulsion in an aqueous solution containing an effective amount of a fog inhibiting agent comprised of at least two divalent middle chalcogen atoms linking two carbocyclic aromatic nuclei characterized in that at least one of said middle chalcogen atoms is a tellurium atom.

15. A process of producing a photographic image according to claim 14 further characterized in that said fog inhibiting agent is initially present in a processing solution in a concentration of from 0.05 to 0.5 millimole per liter.

* * * * *